US006937203B2

(12) United States Patent
Rao et al.

(10) Patent No.: US 6,937,203 B2
(45) Date of Patent: Aug. 30, 2005

(54) MULTI-BAND ANTENNA SYSTEM SUPPORTING MULTIPLE COMMUNICATION SERVICES

(75) Inventors: Sudhakar K. Rao, Yardley, PA (US); James Wang, Yardley, PA (US); Joel A. Fink, Torrence, CA (US)

(73) Assignee: The Boeing Company, Chicago, IL (US)

( * ) Notice: Subject to any disclaimer, the term of this patent is extended or adjusted under 35 U.S.C. 154(b) by 11 days.

(21) Appl. No.: 10/714,421

(22) Filed: Nov. 14, 2003

(65) Prior Publication Data

US 2005/0104794 A1 May 19, 2005

(51) Int. Cl.[7] ..... H01Q 13/00

(52) U.S. Cl. ..... 343/786; 343/772; 333/21 A; 333/125

(58) Field of Search ..... 343/756, 772, 343/781 R, 786; 333/21 A, 125, 126

(56) References Cited

U.S. PATENT DOCUMENTS 3,696,434 A * 10/1972 Sciambi, Jr. ..... 343/776
4,847,574 A * 7/1989 Gauthier et al. ..... 333/21 A
6,005,528 A * 12/1999 Preiss et al. ..... 343/786
6,094,175 A * 7/2000 Alessi et al. ..... 343/786
6,812,807 B2 * 11/2004 Ergene et al. ..... 333/125

* cited by examiner

*Primary Examiner*—Hoang V. Nguyen
(74) *Attorney, Agent, or Firm*—Thomas F. Lebens; Fitch, Even, Tabin & Flannery

(57) ABSTRACT

An antenna comprising a reflector having a reflector surface profile for reflecting a plurality of signals comprising a plurality of communication bands; a multi-depth corrugated horn assembly for receiving the signal comprising the plurality of communication bands; a stepped waveguide coupled to the corrugated horn; a first polarizer coupled to the stepped waveguide for separating a first communication band from the plurality of communication bands; a second polarizer coupled to the stepped waveguide for separating a second communication band from the plurality of communication bands; and a third polarizer coupled to the stepped waveguide for separating a third communication band from the plurality of communication bands. The antenna can simultaneously operate in the K, Ka and EHF frequency bands. Extension of this antenna to include five separate frequency bands is demonstrated.

23 Claims, 20 Drawing Sheets

| 20.2 GHz Performance Summary | | |
|---|---|---|
| Beam Number | Min. EOC Gain (dB) | Peak Performance |
| 1 | 37.41 | 40.51 |
| 2 | 37.29 | 40.33 |
| 3 | 37.40 | 40.30 |
| 4 | 37.32 | 40.29 |
| 5 | 37.28 | 40.33 |
| 6 | 37.20 | 40.36 |
| 7 | 37.37 | 40.33 |
| 8 | 37.25 | 40.30 |
| 9 | 37.28 | 40.32 |
| Minimum EOC | 37.20 | |

30.5 GHz Performance Summary

| Beam Number | Min. EOC Gain (dB) | Peak Performance |
|---|---|---|
| 1 | 37.31 | 43.05 |
| 2 | 37.00 | 42.85 |
| 3 | 37.30 | 42.76 |
| 4 | 37.19 | 42.71 |
| 5 | 37.14 | 42.76 |
| 6 | 37.04 | 42.80 |
| 7 | 37.26 | 42.80 |
| 8 | 37.15 | 42.79 |
| 9 | 37.31 | 42.83 |
| Minimum EOC | 37.00 | |

45 GHz Performance Summary After Shapping

| Beam Number | Min. EOC Gain (dB) | Peak Performance |
|---|---|---|
| 1 | 41.72 | 44.74 |
| 2 | 41.32 | 44.65 |
| 3 | 41.31 | 44.52 |
| 4 | 41.00 | 44.38 |
| 5 | 41.32 | 44.39 |
| 6 | 41.10 | 44.49 |
| 7 | 41.32 | 44.54 |
| 8 | 41.05 | 44.57 |
| 9 | 41.43 | 44.83 |
| Minimum EOC | 41.05 | |

| 20.2 GHz Performance Summary | | |
|---|---|---|
| Beam Number | Min. EOC Gain (dB) | Peak Performance |
| 1 | 42.13 | 47.27 |
| 2 | 42.11 | 47.00 |
| 3 | 41.75 | 46.46 |
| 4 | 41.65 | 45.97 |
| 5 | 41.51 | 46.45 |
| 6 | 41.48 | 46.99 |
| 7 | 41.35 | 46.74 |
| 8 | 41.57 | 46.42 |
| 9 | 41.36 | 46.73 |
| Minimum EOC | | |

| 30.5 GHz Performance Summary | | |
|---|---|---|
| Beam Number | Min. EOC Gain (dB) | Peak Performance |
| 1 | 39.00 | 50.85 |
| 2 | 39.46 | 50.32 |
| 3 | 39.31 | 49.19 |
| 4 | 38.87 | 48.21 |
| 5 | 38.90 | 49.17 |
| 6 | 38.78 | 50.29 |
| 7 | 38.58 | 49.61 |
| 8 | 38.42 | 48.88 |
| 9 | 38.65 | 49.56 |
| Minimum EOC | 38.58 | |

MULTI-BAND ANTENNA SYSTEM SUPPORTING MULTIPLE COMMUNICATION SERVICES

BACKGROUND OF THE INVENTION

1. Field of the Invention

The present invention relates generally to antennas. Even more specifically, the present invention relates to a system and method for transmitting and/or receiving multiple frequency bands using a single antenna.

2. Discussion of the Related Art

The existing antenna systems used for satellite payloads, aircraft terminals or ground terminals are designed to carry either single or dual frequency band(s) supporting a particular communication service. For example, the Ka-band antennas for Wideband Gapfiller Satellite (WGS) support 20 GHz and 30 GHz frequency bands with less than 40% bandwidth. Future military communication antennas are required to support multiple communication services covering a few or all of the X, K, Ka and EHF bands. This requires an antenna system with about 150% bandwidth and covering more than 6 octaves of frequency bandwidth.

One prior design, as shown in U.S. Pat. No. 6,208,312, issued Mar. 27, 2001, for MULTI-FEED MULTI-BAND ANTENNA, to Gould, which is fully incorporated herein by reference, is an antenna that supports C and Ku band frequencies. The antenna employs a center-fed paraboloid with separate feeds for each band. Each feed covers a narrow bandwidth and the polarization is dual-linear. Another prior design, as shown in U.S. Pat. No. 5,485,167, issued Jan. 16, 1996, for MULTI-FREQUENCY BAND PHASED ARRAY ANTENNA USING MULTIPLE LAYERED DIPOLE ARRAYS, to Wong et al., which is fully incorporated herein by reference, is a multi-frequency band phased array antenna using multiple layered dipole arrays. In this design, each layer is tuned to a difference frequency band and all the layers are stacked together to form frequency selective surfaces. The highest frequency array is on the top of the radiating surface while the lowest frequency array is at the bottom most layer. Disadvantages with this approach are the low antenna efficiency due to increased losses, interactions among layers, high mass and cost associated with phased arrays.

Another version of multi-layered multi-band antenna, as shown in U.S. Pat. No. 6,452,549, issued Sep. 17, 2002, for STACKED MULTI-BAND LOOK-THROUGH ANTENNA, to Lo, which is fully incorporated herein by reference, uses printed dipole elements and slots. In this design, low frequency layer is kept on top of the array while the high frequency layer is kept at the bottom side and both these layers share a common ground-plane at the bottom. It also has similar disadvantages as the multi-frequency band phased array antenna that was mentioned before. Yet another design, as shown in U.S. Pat. No. 5,977,928, issued Nov. 2,1999, for HIGH EFFICIENCY, MULTI-BAND ANTENNA FOR RADIO COMMUNICATION DEVICE, to Ying et al., which is fully incorporated herein by reference, is a multi-band antenna useful for radio communications (AM/FM) by using a multi-band swivel antenna assembly being implemented in coaxial medium. This approach works well over a narrow band and is not suitable at high frequencies. The antenna has very low-gain due to the omni-directional radiation patterns.

SUMMARY OF THE INVENTION

In one embodiment, the invention can be characterized as an antenna comprising a reflector having a reflector surface profile for reflecting a plurality of signals comprising a plurality of communication bands; a multi-depth corrugated horn assembly for transmitting and/or receiving the signals comprising the plurality of communication bands; a stepped waveguide coupled to the corrugated horn; a first polarizer coupled to the stepped waveguide for separating a first communication band from the plurality of communication bands; a second polarizer coupled to the stepped waveguide for separating a second communication band from the plurality of communication bands; and a third polarizer coupled to the stepped waveguide for separating a third communication band from the plurality of communication bands.

In another embodiment, the invention can be characterized as a method of transmitting data comprising reflecting a signal comprising a plurality of communication bands into a corrugated horn having dual depth corrugations; and separating each of the plurality of communication bands with a multi-band polarizer; wherein plurality of communication bands comprises a K-band signal, a Ka-band signal and a EHF-band signal.

In a further embodiment, the invention may be characterized as a feed for an antenna system comprising a wideband corrugated horn comprising a plurality of dual depth corrugations; a waveguide coupled to the wideband corrugated horn, the waveguide comprising a first step junction and a second step junction; a first polarizer coupled to the waveguide in between the wideband corrugated horn and the first step junction; a second polarizer coupled to the waveguide in between the first step junction and the second step junction; and a third polarizer coupled to the waveguide after the second step junction.

In yet another embodiment, the invention may be characterized as an apparatus for use in a communication system comprising means for reflecting a set of beams from an antenna into an antenna feed, the set of beams comprising a K-band signal, a Ka-band signal, and an EHF-band signal; means for separating the K-band signal from the set of beams; means for separating the Ka-band signal from the set of beams; and means for separating the EHF-band signal from the set of beams.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

Figure 1:
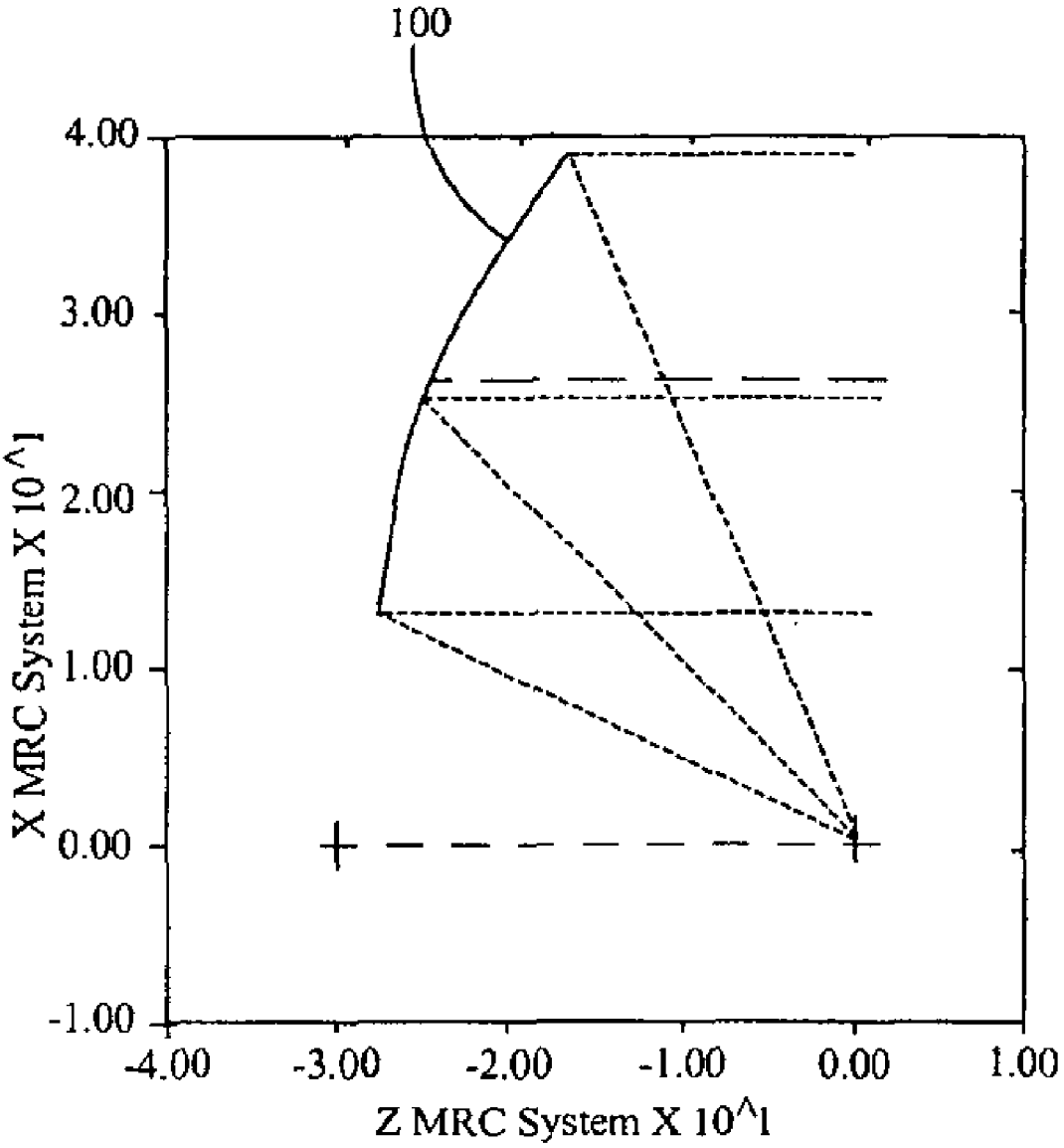
FIG. 1 is a diagram illustrating a reflector geometry for a multi-band antenna system.

The following description is not to be taken in a limiting sense, but is made merely for the purpose of describing the general principles of the invention. The scope of the invention should be determined with reference to the claims.

Military communications have been evolving from single band systems (X-band, 8 GHz) for Defense Satellite Communication Systems (DSCS) to dual-band systems at X and Ka-bands for Wideband Gapfiller Satellite (WGS) for improved coverage, connectivity, data throughput, bandwidth and flexibility. The WGS system currently uses separate antennas for X-band (7.5 GHz/8.25 GHz) and Ka-band (20 GHz/30 GHz) services due to lack of an antenna system that can cover multiple octave bandwidths from 7.25 GHz to 31 GHz. A common antenna covering these bands shall significantly increase the communications capability of the WGS. In order to meet the needs of a warfighter, future communications enhancements will be driven towards improved connectivity, anti jam performance, support to small terminal users, and large increases in data throughput. The present invention provides enhancements to the current Extremely High Frequency (EHF) payloads and offers significantly increased communications capabilities. The present invention offers both WGS and EHF services from the same antenna and may also be extended to provide X-band communications services. Next generation Family of Advanced and Beyond line-of-sight Terminals (FAB_T) terminals on aircrafts and ground are also required to carry both EHF and WGS services (20 GHz, 30 GHz & 45 GHz). These current and future communication requirements for satellite-based, aircraft-based and ground-based systems necessitate the development of advanced multiband antenna systems that can simultaneously support multiple communication services at X, K, Ka and EHF bands (8 GHz, 20 GHz, 30 GHz & 45 GHz).

One embodiment includes a single tri-band antenna system that is capable of supporting simultaneously WGS and EHF services at 20 GHz (common to both bands), 30 GHz (for WGS only) and 45 GHz (for EHF only). The antenna employs a novel tri-band feed system with a six-port othomode transducer and polarizer (OMT/Polarizer) assembly, supporting both left hand and right hand circular polarizations at each of the three bands. In one embodiment, the antenna is extended to a Quad-Band Antenna that adds X-band capabilities. In another embodiment, the antenna employs a single offset reflector being fed with a multi-band feed system including a horn and an OMT and polarizer supporting multiple services and forming congruent beams. The beams are scanned around the global field-of-view for satellite-based systems by gimbaling the reflector while keeping the feed system stationary.

This present invention includes a method and an apparatus for an antenna system that can operate at multiple frequency bands that are widely separated. The antenna system is therefore capable of supporting multiple services such as WGS, EHF and X-band military communications. The disclosed multi-band antenna is capable of being used in many applications, e.g., satellite payloads, aircraft terminals and ground terminals.

The multi-band antenna system comprises an offset reflector being illuminated with multi-band feed assembly. The reflector surface can either be parabolic or shaped to optimize the gain performance over the desired number of frequency bands. In one embodiment the reflector produces congruent beams over all the frequency bands. The congruent set of beams can be reconfigured over different angular locations (for example over the earth's field-of-view as seen by the satellite) by gimbaling the reflector using a pair of articulated mechanisms that are located behind the reflector. The feed assembly remains stationary for various beam locations. The feed assembly comprises of an extremely wide-band corrugated horn using multiple depth corrugation sets, each of which is optimized to operate over a specific frequency band in order to provide low cross-polar levels that are required for dual-polarization operation. The corrugated horn is fed with the OMT/Polarizer assembly that supports multiple bands and dual-circular polarization operation through an N-port network (N=6 for tri-band operation).

In one preferred embodiment, the antenna system has one or more of the following advantages and features as compared to prior designs: operation over multiple frequency bands that are widely separated, supports a plurality of communication services using a single antenna, generation of a congruent set of beams over all frequency bands, the beams can be reconfigured over a large coverage region (for example, global coverage for satellite based systems) by keeping the feed system stationary while gimbaling the reflector using two articulated mechanisms (one for azimuth gimbaling and the other for elevation gimbaling), the reflector surface can be shaped in order to minimize scan loss over the coverage region, the antenna system is inexpensive and supports frequency bands that are separated over multiple octaves in order to carry multiple communication services, the feed system employs a wideband multi-depth corrugated horn that operates over several frequency bands and is fed with an N-port OMT/Polarizer (e.g., N greater than or equal to 6) that can support dual-polarization capability at each band, the surface of the reflector can be shaped in order to optimize the antenna directivity performance over all the frequency bands, a tri-band feed system that generates K/Ka/EHF bands using a single feed assembly, the tri-band feed assembly comprises in one embodiment an extremely wide-band corrugated horn and an OMT/Polarizer, the corrugated horn includes novel multi-depth corrugations and an input matching section in order to meet more than an octave bandwidth with very good input match and low cross-polarization levels, the OMT/Polarizer can included in one embodiment a six-port network that is capable of producing dual-circular polarizations (LHCP & RHCP) at each of the three bands with low axial ratio performance, other bands such as the X-band and the C-band can be generated by using the same reflector and adding helical elements around the tri-band feed. The present invention can be applied to many applications including, e.g., satellite based, aircraft based and ground based systems such as future generation WGS, FAB_T, and Transformational Communication Systems (TCS).

Figure 12:
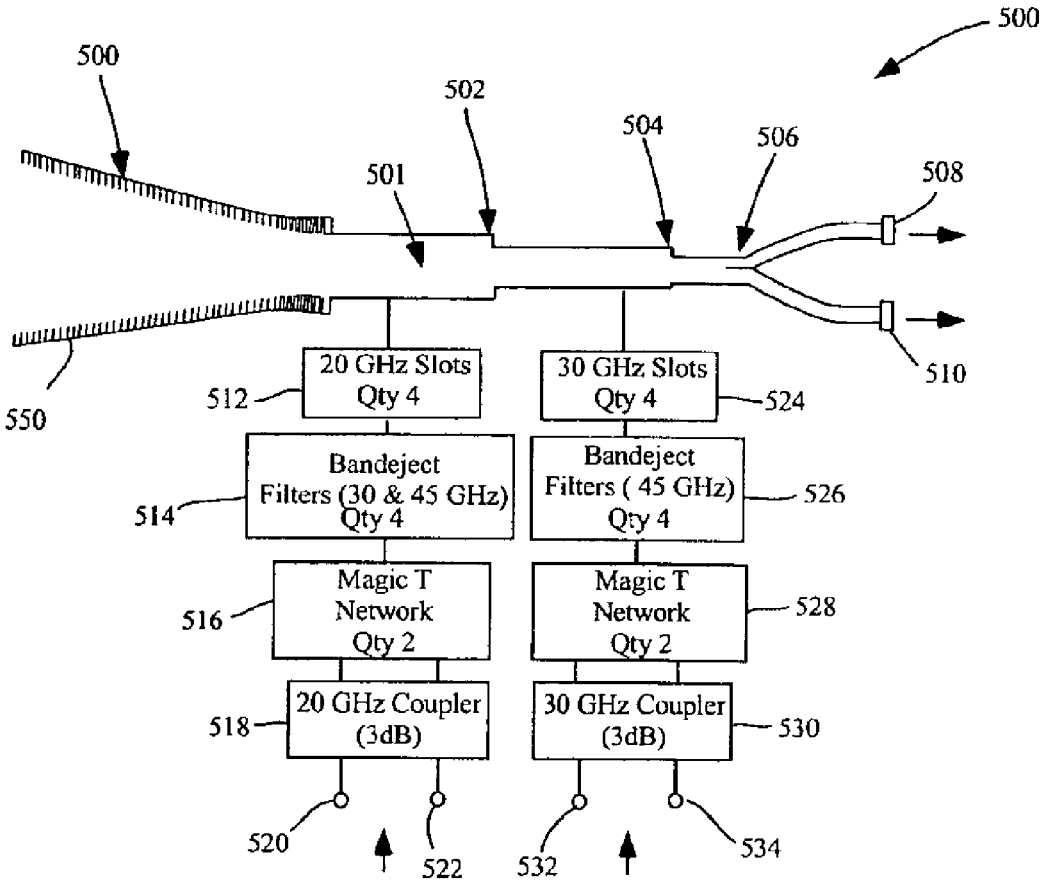
FIG. 12 is a diagram illustrating a tri-band feed assembly for use with the reflectors shown in FIGS. 1 and 9.

Turning now to one specific embodiment, FIG. 1 shows a reflector geometry of the multi-band antenna system. The reflector 100 employs a 26 inches diameter offset reflector antenna with a focal length of 30 inches and an offset clearance of 13 inches. In one embodiment, the reflector 100 is fed with a multi-band feed system for simultaneous operation of the C, X, K, Ka and EHF frequency bands. One component of the feed system, shown in FIG. 12, is the tri-band feed assembly that is operational at K (20 GHz), Ka (30 GHz) and EHF (45 GHz) frequency bands simultaneously and can provide, in a preferred embodiment, dual-circular polarization (RHCP & LHCP) capability at each of the three bands. The tri-band feed assembly comprises an extremely wideband (about 80% bandwidth) corrugated horn (also referred to herein as the corrugated horn or the horn) and an Orthomode Transducer/Polarizer assembly with 6 ports corresponding to three frequency bands and two orthogonal polarization ports per frequency band.

The corrugated horn defocusing as well as the shaping of the reflector surface profile are used as parameters in order to optimize the antenna beams over all the three frequency bands. Table 1 shows the summary of antenna minimum directivity values over a 1.71 deg. diameter coverage circle (1.51 deg. with +/−0.1 deg. pointing error) and over the global field-of-view. Both peak (P) and edge (E) directivity values in dBi are shown in Table 1.

TABLE 1

| | DF = 0.0" | DF = 2.5" | DF = 3.0" | DF = 3.5" | DF = 4.0" |
|---|---|---|---|---|---|
| 20.2 GHz | 39.87 (P) | 40.78 | 40.78 | 40.70 | 40.54 |
| | 36.64 (E) | 37.14 | 37.15 | 37.10 | 37.01 |
| 30.5 GHz | 39.43 | 42.73 | 43.07 | 43.27 | 43.33 |
| | 37.06 | 36.94 | 36.86 | 36.80 | 36.81 |
| 45.0 GHz | 39.06 | 43.09 | 43.89 | 44.85 | 44.95 |
| | 38.32 | 40.63 | 40.85 | 41.02 | 41.15 |

Figure 2:
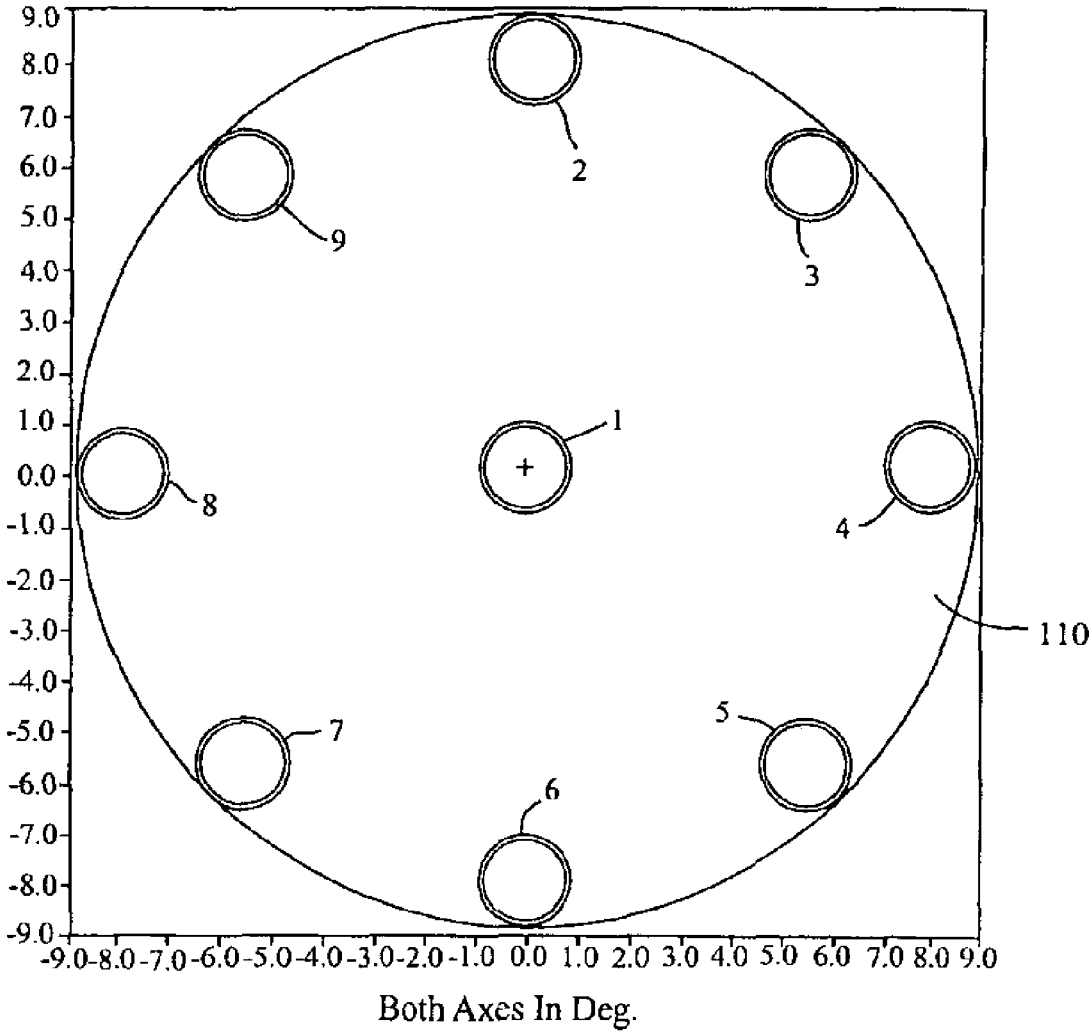
FIG. 2 is a diagram illustrating nine evaluation beams for the reflector shown in FIG. 1.

A 4 inch feed defocusing (the multi-band feed system is moved towards reflector) can be used for the antenna based upon directivity evaluation over the three bands. Nine beams were used for evaluating the performance of the tri-band antenna and are shown in FIG. 2. Shown is a first beam 1, a second beam 2, a third beam 3, a fourth beam 4, a fifth beam 5, a sixth beam 6, a seventh beam 7, a eighth beam 8, a ninth beam 9, and the earth's coverage circle 110. The inner circles are 1.51 deg. in diameter and the outer circles that include satellite pointing error are 1.71 deg. in diameter. The outer circles are used for the minimum directivity evaluation of the nine beams that are spread over the global field-of view as seen by the satellite. The sidelobes are evaluated outside a circle of 5.13 deg. diameter. The scanned beams are obtained by gimbaling the reflector 100. Shaping the reflector 100 surface at the three bands (K, Ka, EHF) improves the minimum edge-of-coverage (EOC) directivity by about 0.5 dB on the average relative to a simple parabolic reflector. The surface of the reflector 100 is synthesized at 9 frequencies (3 freq. at each band) using the corrugated horn patterns described later with reference to FIGS. 12 and 13. The corrugated horn is defocused by 4 inches, towards the reflector (aperture of the horn is 4 inches away from the focal point of the reflector) in order to minimize the phase errors at Ka and EHF bands and to achieve better directivity performance.

Figure 3:
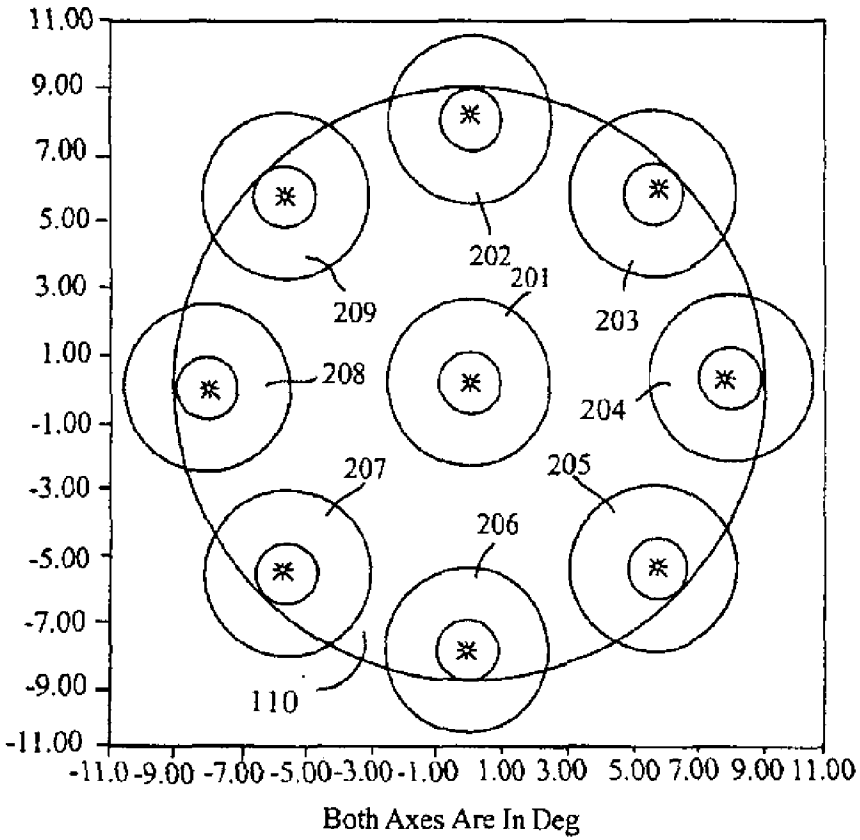
FIG. 3 is a diagram illustrating the computed beam contours at K-band for the multi-band antenna system using the reflector of FIG. 1 and an evaluation table of the beams.
Figure 4:
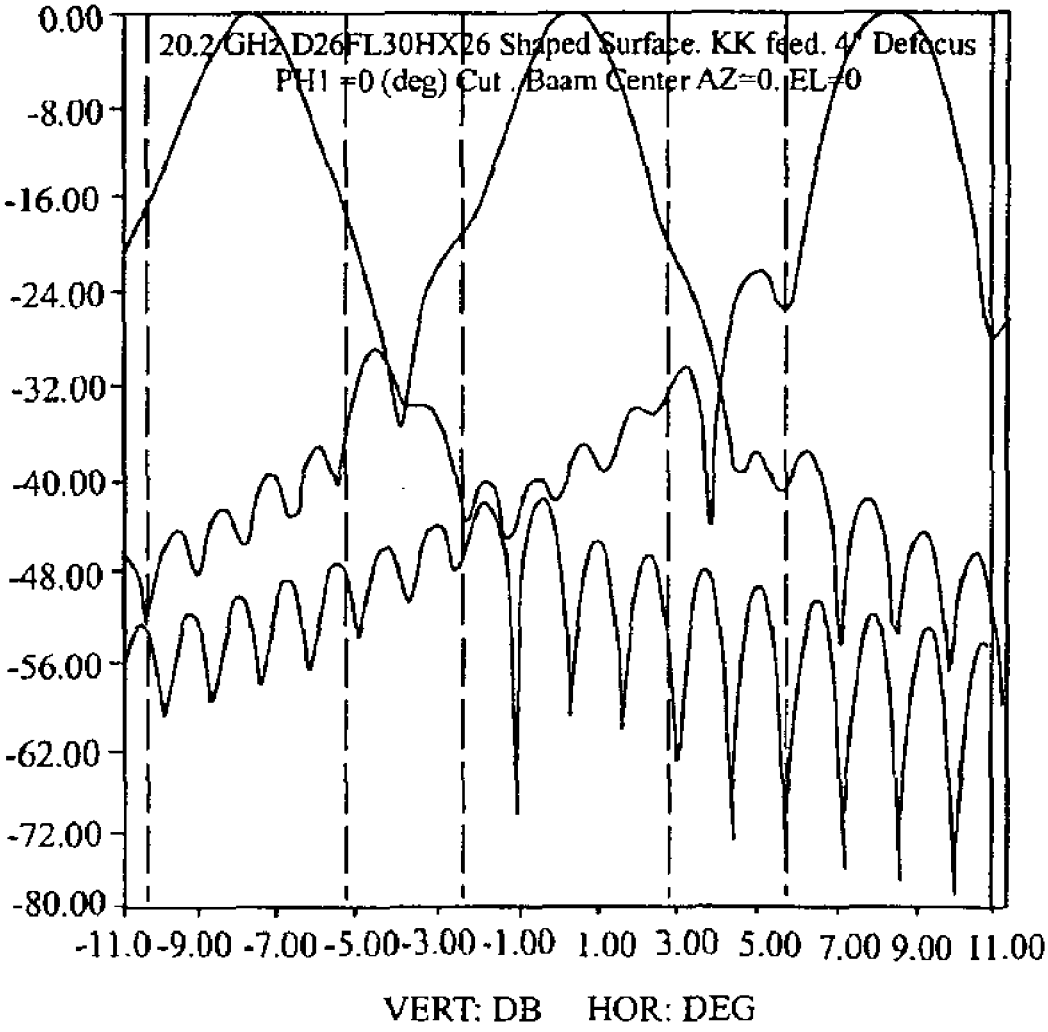
FIG. 4 is a diagram illustrating the azimuth pattern cuts at K-band for the first three beams of FIG. 3.
Figure 5:
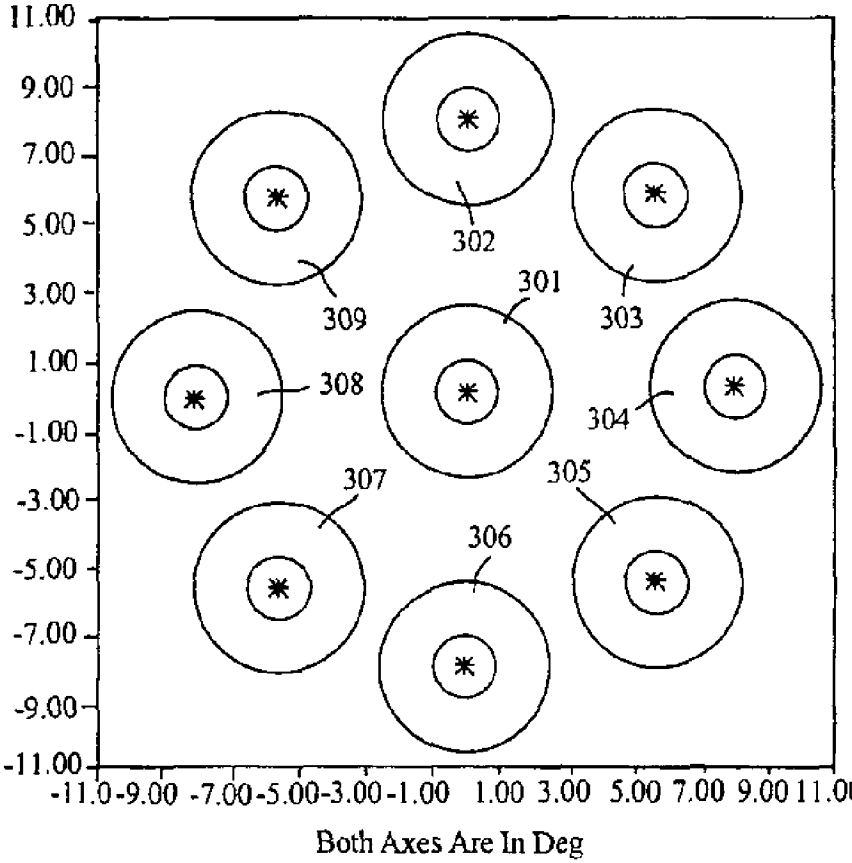
FIG. 5 is a diagram illustrating the computed beam contours at Ka-band for the multi-band antenna system using the reflector of FIG. 1 and an evaluation table of the beams.
Figure 6:
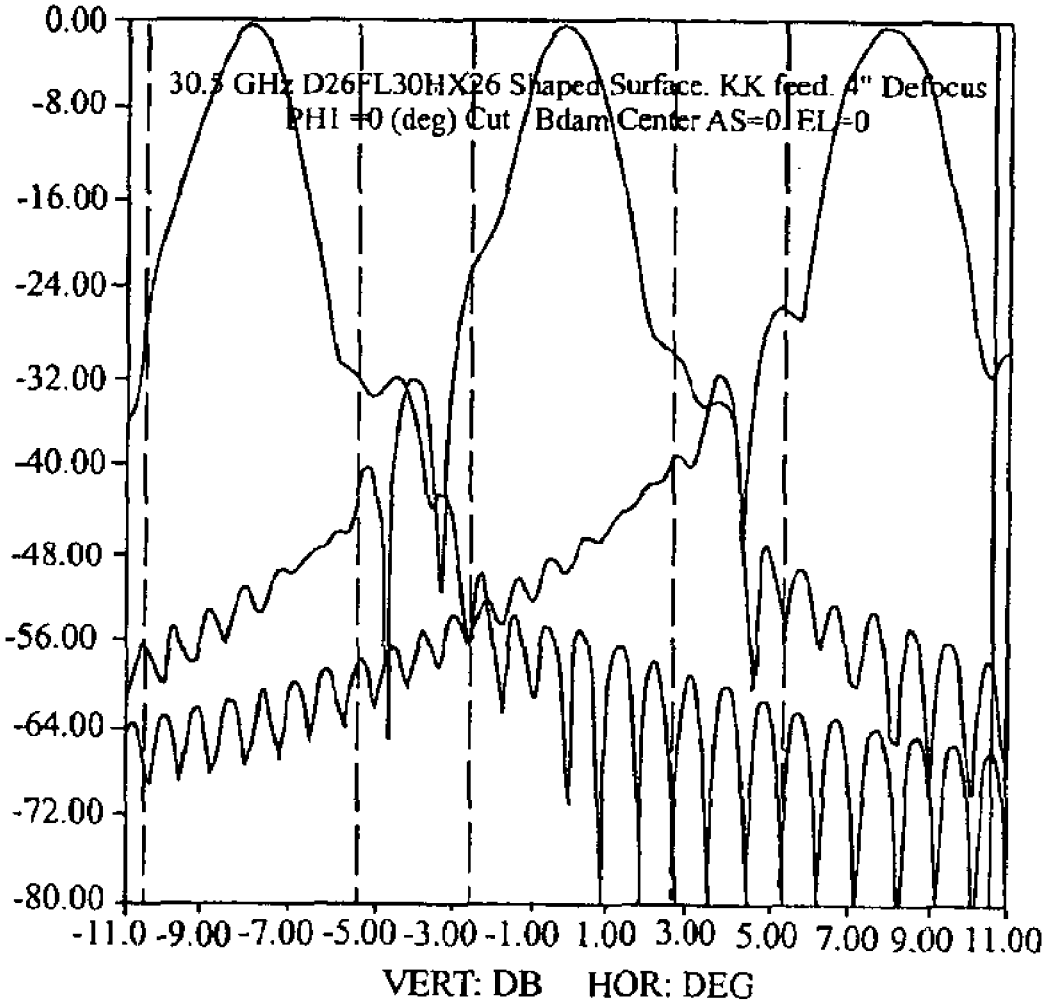
FIG. 6 is a diagram illustrating the azimuth pattern cuts at Ka-band for the first three beams of FIG. 5.
Figure 7:
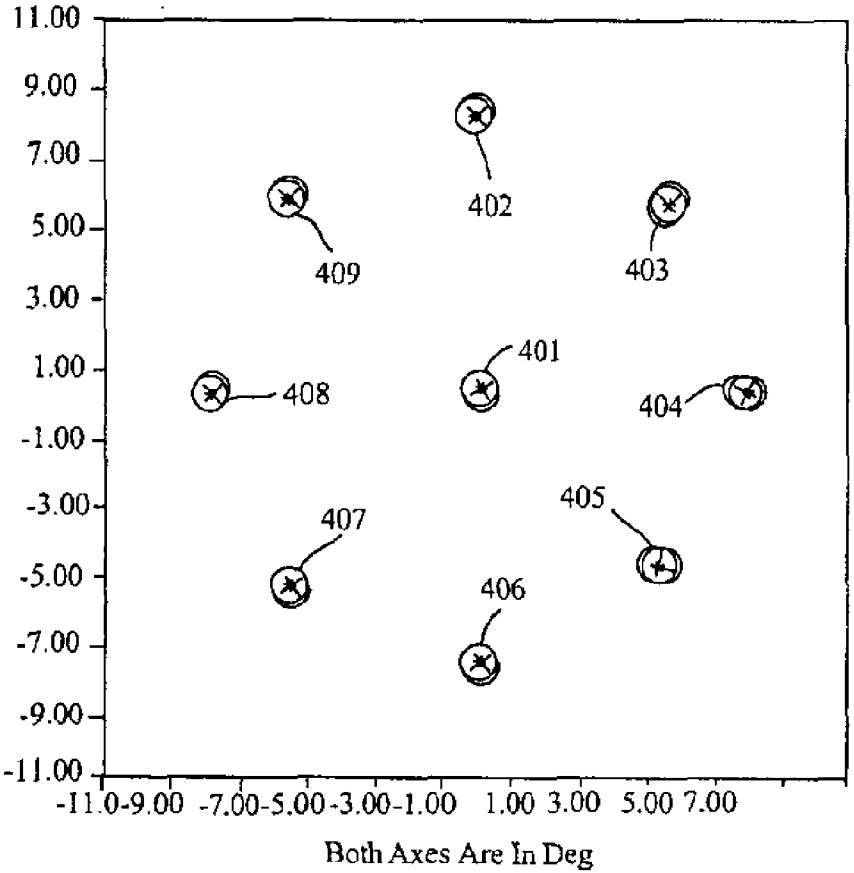
FIG. 7 is a diagram illustrating the computed beam contours at EHF-band for the multi-band antenna system using the reflector of FIG. 1 and an evaluation table of the beams.
Figure 8:
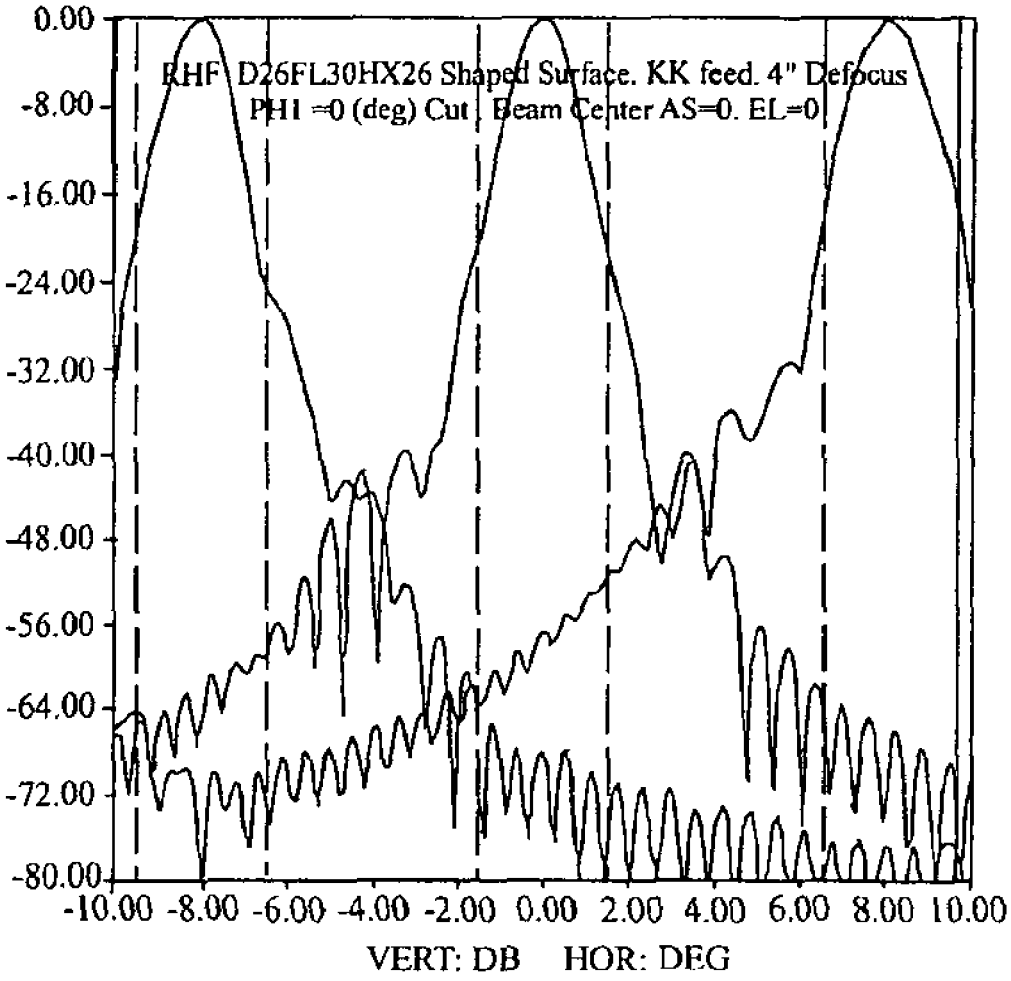
FIG. 8 is a diagram illustrating the azimuth pattern cuts at EHF-band for the first three beams of FIG. 7.

FIG. 3 shows the tri-band antenna beam contours of the 9 beams at K-band (20.2 to 21.2 GHz) and the minimum directivity evaluation table for all the beams. Shown is a first beam 201, a second beam 202, a third beam 203, a fourth beam 204, a fifth beam 205, a sixth beam 206, a seventh beam 207, a eighth beam 208, a ninth beam 209, and the earth's coverage circle 110. The minimum EOC directivity over the global coverage evaluated at three frequencies (low, mid and high) is 37.20 dBi. The radiation pattern cuts along the azimuth plane of FIG. 3 for the three azimuth beams (beams 201,204 and 208) are shown in FIG. 4. Sidelobes outside the dotted lines are lower than −21 dB relative to the peak and can be improved, if desired. The computed directivity contours at Ka-band and the corresponding performance evaluation table are shown in FIG. 5 and the azimuth pattern cuts are shown in FIG. 6. Shown in FIG. 5 is a first beam 301, a second beam 302, a third beam 303, a fourth beam 304, a fifth beam 305, a sixth beam 306, a seventh beam 307, a eighth beam 308, a ninth beam 309, and the earth's coverage circle 110. Minimum EOC directivity at Ka-band is 37.0 dBi and the sidelobes are better than −26 dB (relative to peak) outside the dotted vertical evaluation lines. The computed directivity plots at EHF band are shown in FIGS. 7 and 8. Shown in FIG. 7 is a first beam 401, a second beam 402, a third beam 403, a fourth beam 404, a fifth beam 405, a sixth beam 406, a seventh beam 407, a eighth beam 408, and a ninth beam 409. At EHF band, the minimum EOC directivity (evaluated at 1.0 deg. diameter coverage circle) is 41.05 dBi and the sidelobes are better than −20 dB relative to the peak.

Figure 9:
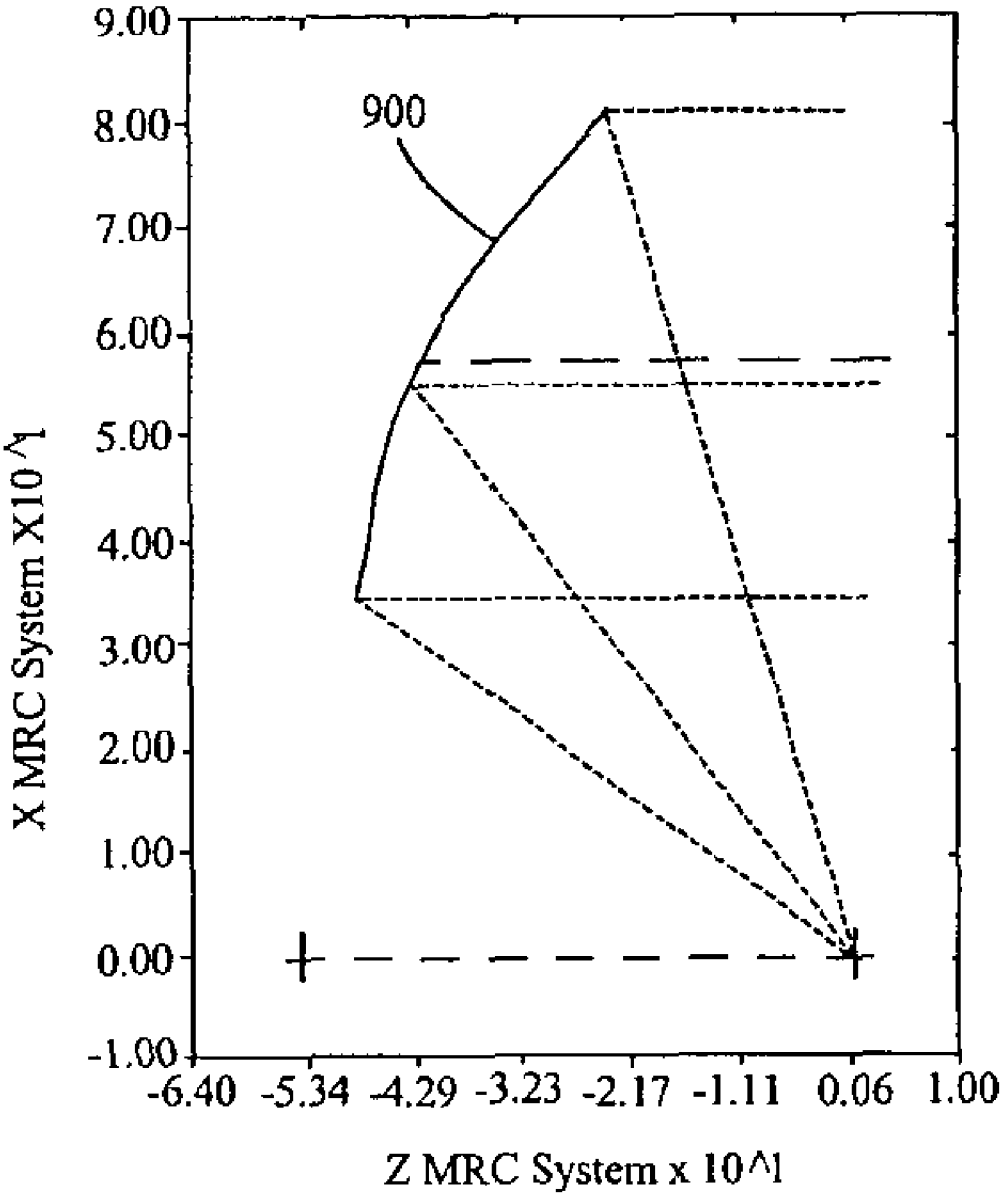
FIG. 9 is a diagram illustrating a high gain reflector geometry for the multi-band antenna system.
Figure 10:
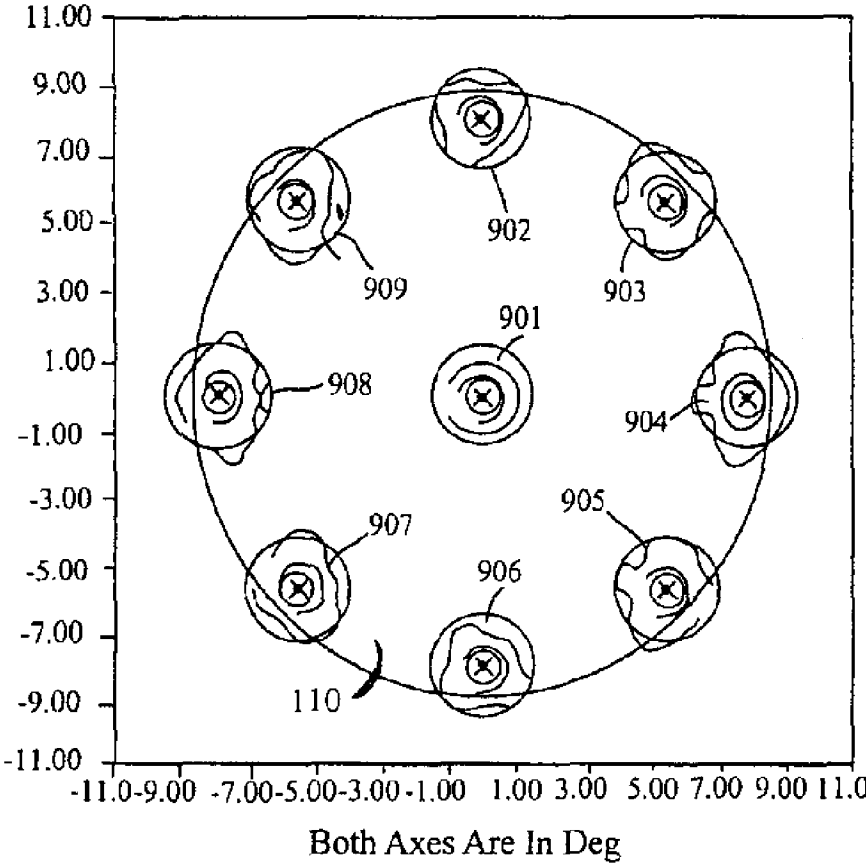
FIG. 10 is a diagram illustrating the computed beam contours at K-band for the multi-band antenna system using the high gain reflector of FIG. 9 and an evaluation table of the beams.
Figure 11:
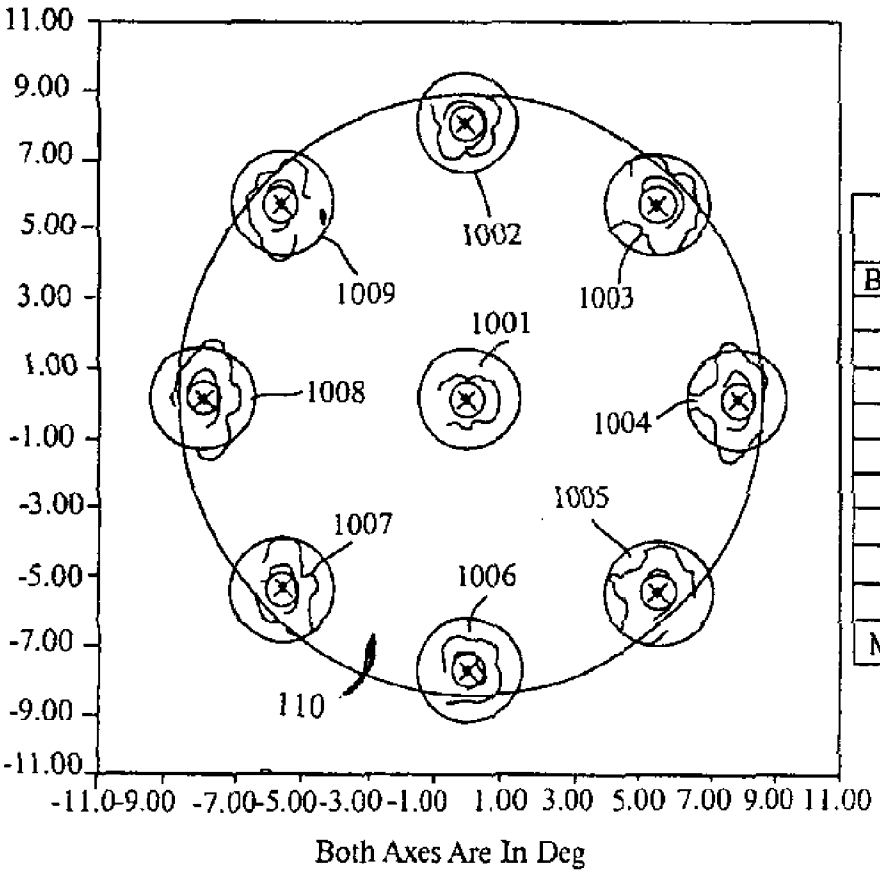
FIG. 11 is a diagram illustrating the computed beam contours at Ka-band for the multi-band antenna system using the high gain reflector of FIG. 9 and an evaluation table of the beams.

Another application of the present invention is a high gain antenna using a 47 inches offset reflector 900 for the TCA (transformational communications architecture) Milsatcom payloads, as shown in FIG. 9. The reflector 900 also employs the tri-band feed assembly and the reflector uses a high offset. Computed beam contours and evaluation tables are shown in FIGS. 10 & 11. Shown in FIG. 10 is a first beam 901, a second beam 902, a third beam 903, a fourth beam 904, a fifth beam 905, a sixth beam 906, a seventh beam 907, a eighth beam 908, a ninth beam 909, and the earth's coverage circle 110. Shown in FIG. 11 is a first beam 1001, a second beam 1002, a third beam 1003, a fourth beam 1004, a fifth beam 1005, a sixth beam 1006, a seventh beam 1007, a eighth beam 1008, a ninth beam 1009, and the earth's coverage circle 110. The evaluation circle for the high gain antenna is 1.0 deg. in diameter at K, Ka and 0.5 deg. diameter at EHF. Minimum edge of coverage (EOC) directivity values are 41.36 dBi, 38.58 dBi and 45.7 dBi at K, Ka and EHF bands respectively.

Referring now to FIG. 12, shown is a tri-band feed assembly 500 configuration. Shown is a corrugated horn 550, a waveguide 501, a first step junction 502, a second step junction 504, a septum polarizer 506, a 45 GHz LHCP port 508, a 45 GHz RHCP port 510, a plurality of 20 GHz slots 512, a plurality of 30 GHz slots 524, a first plurality of band reject filters 514, a second plurality of band reject filters 526, a first plurality of magic T networks 516, a second plurality of magic T networks 528, a K-band short-slot coupler 518, a 20 GHz LHCP port 520, a 20 GHz RHCP port 522, a Ka-band short-slot coupler 530, a 30 GHz LHCP port 532, and a 30 GHz RHCP port 534.

In one embodiment the feed assembly 500 comprises the corrugated horn 550, (e.g., a multi-depth wideband corrugated horn), the waveguide 501, and a 6-port Tri-band OMT/Polarizer (TOP) which includes in on example, the septum polarizer 506, the 45 GHz LHCP port 508, the 45 GHz RHCP port 510, the plurality of 20 GHz slots 512, the plurality of 30 GHz slots 524, the first band reject filter 514, the second band reject filter 526, the first magic T network 516, the second magic T network 528, the K-band short-slot coupler 518, and the Ka-band short-slot coupler 530, as shown in FIG. 12.

The corrugated horn 550 is coupled to the waveguide 501. The waveguide 501 has the first step junction 502 and the second step junction 504. The waveguide 501 has in it the plurality of 20 GHz slots 512 in between the corrugated horn 550 and the first step junction 502. The plurality of 30 GHz slots 524 are on the waveguide 501 in between the first step junction 502 and the second step junction 504. The septum polarizer 506, having the 45 GHz LHCP port 508 and the 45 GHz RHCP port 510, is coupled to the waveguide 501 after the second step junction 504.

The plurality of 20 GHz slots 512 are coupled to the first plurality of band reject filters 514. The first plurality of band reject filters 514 are coupled to the first plurality of magic T networks 516. The first plurality of magic T networks 516 is coupled to the K-band short slot coupler 518. The K-band short slot coupler has the 20 GHz LHCP port 520 and the 20 GHz RHCP port 522.

The plurality of 30 GHz slots 524 are coupled to the second plurality of band reject filters 526. The second plurality of band reject filters 526 are coupled to the second plurality of magic T networks 528. The second plurality of magic T networks 528 is coupled to the Ka-band short slot coupler 530. The Ka-band short slot coupler has the 30 GHz LHCP port 532 and the 30 GHz RHCP port 534.

In one embodiment, a K-band polarizer comprises the plurality of 20 GHz slots 512, the first plurality of band reject filters 514, the first plurality of magic T networks 518, the K-band short slot coupler 520, the 20 GHz LHCP port 520 and the 20 GHz RHCP port 522.

In one embodiment, a Ka-band polarizer comprises the plurality of 30 GHz slots 524, the second plurality of band reject filters 526, the second plurality of magic T networks 528, the Ka-band short slot coupler 530, the 30 GHz LHCP port 532 and the 30 GHz RHCP port 534.

In another embodiment, the K-band polarizer comprises a symmetrical 4-port K-band OMT/Polarizer section with the plurality of 20 Hz slots 512 (e.g., 4 slots), the first plurality of band reject filters 514 (e.g., 4 band reject filters for Ka and EHF bands), the first plurality of magic T networks 516 (e.g., 2 magic-T networks), and the K-band short-slot coupler 518 for generating dual-circular polarization signals.

In a further embodiment, the Ka-band polarizer comprises a symmetrical 4-port design that is similar to the K-band. The Ka-band polarizer comprises the plurality of 30 GHz slots 524 (e.g., 4 Ka-band slots), the second plurality of band reject filters 526 (e.g., 4 EHF reject filters), the second plurality of magic T networks 528 (e.g., 2 magic-T networks) and a Ka-band short-slot coupler 530 for generating the LHCP and RHCP signals at Ka-band frequencies.

An EHF OMT/Polarizer assembly comprises the septum polarizer 506 the 45 GHz LHCP port 508 and the 46 GHz RHCP port 510, as shown in FIG. 12. The tri-band feed assembly 500 is capable of radiating over three widely separated bands (e.g., K, Ka, EHF) with low cross-polarization and with dual-circular polarization at each band. In a preferred embodiment, the tri-band feed assembly is capable of radiating over the K, Ka, and EHF bands with low cross-polarization and with dual-circular polarization at each band.

The waveguide 501, in one example, is a common longitudinal circular waveguide having a first step junction 502 and a second step junction 504. The first step junction 502 acts as a short for K-band signals and propagates the Ka and EHF signals. The waveguide 501 section is further reduced in diameter by the second step junction 504 that cuts off Ka-band signals and allows propagation of only EHF signals.

Figure 13:
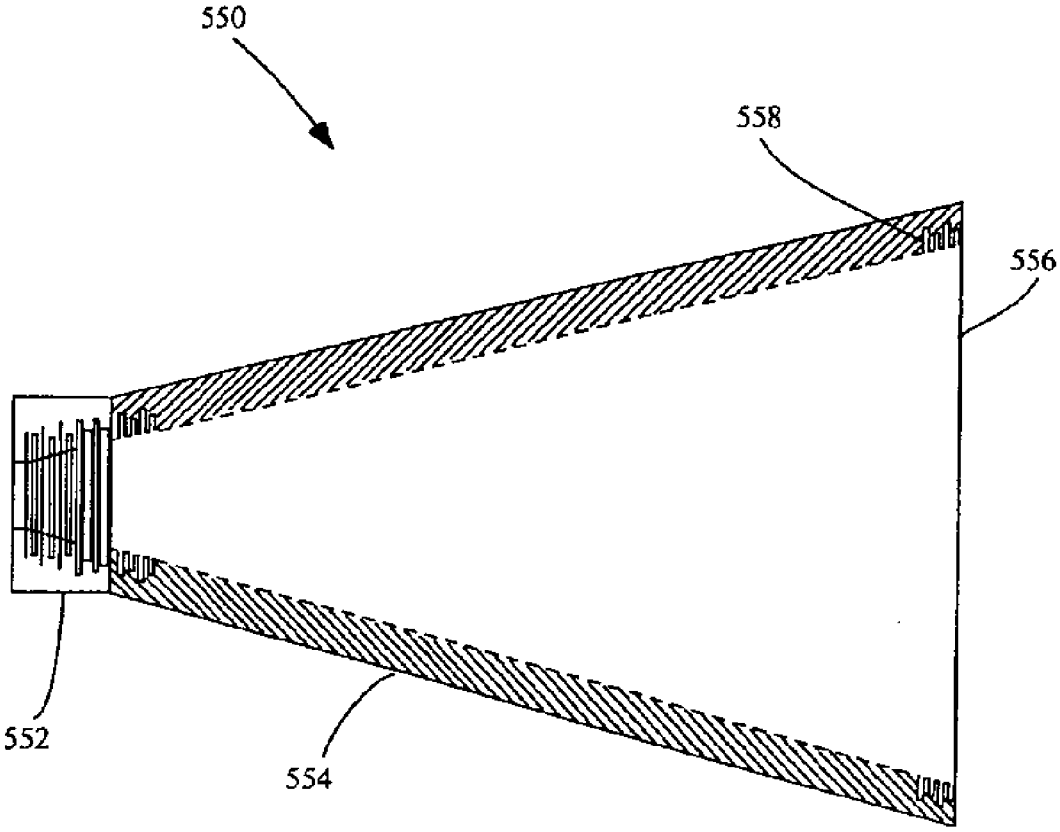
FIG. 13 is a is a detailed view of a corrugated horn having multi-depth corrugations for use with the tri-band feed assembly shown in FIG. 12.

The corrugated horn 550 has a radiating section and an input matching section, shown in FIG. 13, with a TE11 to HE11 mode-converter. The design of the corrugated horn 550 was very challenging due to the fact that it is advantageous, in one embodiment, if the corrugated horn 550 covers an 80% bandwidth while achieving low cross-polar radiation. In addition, it is advantageous, in one embodiment, for the corrugated horn 550 to satisfy displaced phase centers requirements at the three discrete bands such that the secondary beams with the reflector are optimized at all three bands. The horn type that is frequently used in prior designs for wide bandwidth capability is the corrugated horn. A single depth corrugated horn that works well at 11 GHz and 17 GHz simultaneously has been made. However, the single depth corrugated horn's bandwidth is limited to 40% and can not be extended further due to inferior cross-polar levels at high frequencies.

The corrugated horn 550 is capable of transmitting or receiving a signal having a plurality of communication bands. For example, in operation, a signal is reflected from the reflector 100, 900 and is fed into the corrugated horn 550. As referred to herein the signal can be one signal containing a plurality of communication bands or the signal can be a plurality of signals that contain the plurality of communication bands. For example, the received combination of the plurality of signals can come from different origins are all referred to herein as the signal. The design of the horn, including the multi-depth corrugations allows for the signal to propagate to the waveguide 501. The signal comprises frequencies corresponding to K, Ka and EHF bands which are at frequencies of about 20 GHz, 30 GHz and 45 GHz, respectively. The waveguide 501 is coupled to the K-band polarizer. The plurality of 20 GHz slots 512 allow for the propagation of the K-band signal. The plurality of band reject filters 514 prevent the further propagation of the Ka-band and EHF band signals. The first plurality of magic T networks 516 and the K-band short slot coupler 518 then generate both the LHCP signal and RHCP signal at the K-band frequencies.

The waveguide 501 comprises a first step junction 502 which allows for the propagation of the Ka-band and EHF-band signals while acting as a short for the K-band signal. After the first step junction 502 the waveguide 501 is coupled to the Ka-band polarizer. The plurality of 30 GHz slots 524 allow for the propagation of the Ka-band signal. The plurality of band reject filters 526 prevent the further propagation of the EHF-band signal. The second plurality of magic T networks 528 and the Ka-band short slot coupler 530 then generate both the LHCP signal and RHCP signal at the Ka-band frequencies.

The waveguide 501 additionally comprises a second step junction 504 which allows for the propagation of the EHF-band signal while acting as a short for the Ka-band signal. The waveguide 501 is coupled to the septum polarizer 506 after the second step junction. The septum polarizer 506 generates both the LHCP signal and RHCP signal at the EHF-band.

The antenna system described in reference to FIG. 12 has been described in terms of a specific embodiment for operation with K, Ka, and EHF signals. In an alternative embodiment, the specific design can be altered to be able to receive signals at different frequency levels without deviating from the scope of the present invention.

Referring to FIG. 13 shown is a tri-band corrugated horn 550 of one embodiment of FIG. 12. Shown is a radiating section 554, an input matching section 552, a plurality of dual-depth corrugations 558, and a horn aperture 556.

The tri-band corrugated horn has a first set of corrugations near the radiating aperture, e.g., dual-depth corrugations and a second set of corrugations near the input matching section. The input matching section 552 is designed to provide good match between the dominant TE11 modes and hybrid HE11 modes over the three bands. The input matching section 552 comprises of a 0.38 inches diameter circular waveguide with 10 corrugations. The slot width and the corrugation depth of these 10 corrugations are varying and are optimized using a mode-matching software program with a gradient search algorithm. The depths of the corrugations range from 0.095 inches to 0.150 inches. The slot widths are in the range 0.012 inches to 0.035 inches and a constant pitch of 0.050 is used for the matching section. The optimized dimensions of the input matching section provide better than 30 dB return loss over the three bands. The input matching section can be modified for different frequency bands without deviating from the scope of the present invention.

The radiating section 554 of the corrugated horn 550 has a 14 degree semi-flare angle and the plurality of dual-depth corrugations 558 e.g., 46 pairs of dual-depth corrugations. Each one of the plurality of dual-depth corrugations 558 has a first slot depth and a second slot depth. The first slot depth is selected as 0.145 inches such that it is about 0.25 wavelengths deep at K-band and about 0.375 wavelengths deep at Ka-band. The second slot depth is selected as 0.097 inches such that it is about 0.25 wavelengths deep at Ka-band and about 0.375 wavelengths deep at EHF band. In an alternative embodiment, the slot depths can be modified such that the corrugated horn will function at different frequencies.

The horn aperture 556 size of the corrugated horn 550 is selected such that the primary patterns roll-off more than 15 dB at +/−20 degrees angular region for the reflector illumination. In a preferred embodiment the tri-band corrugated horn 550 has an axial length of about 5.5 inches and an aperture diameter of 3.16 inches. The dimensions of the corrugated horn 550 can be changed without deviating from the scope of the present invention. For example, if the frequency bands the horn is designed to operate change, the dimensions of the corrugated horn 550 can also change.

Figure 14:
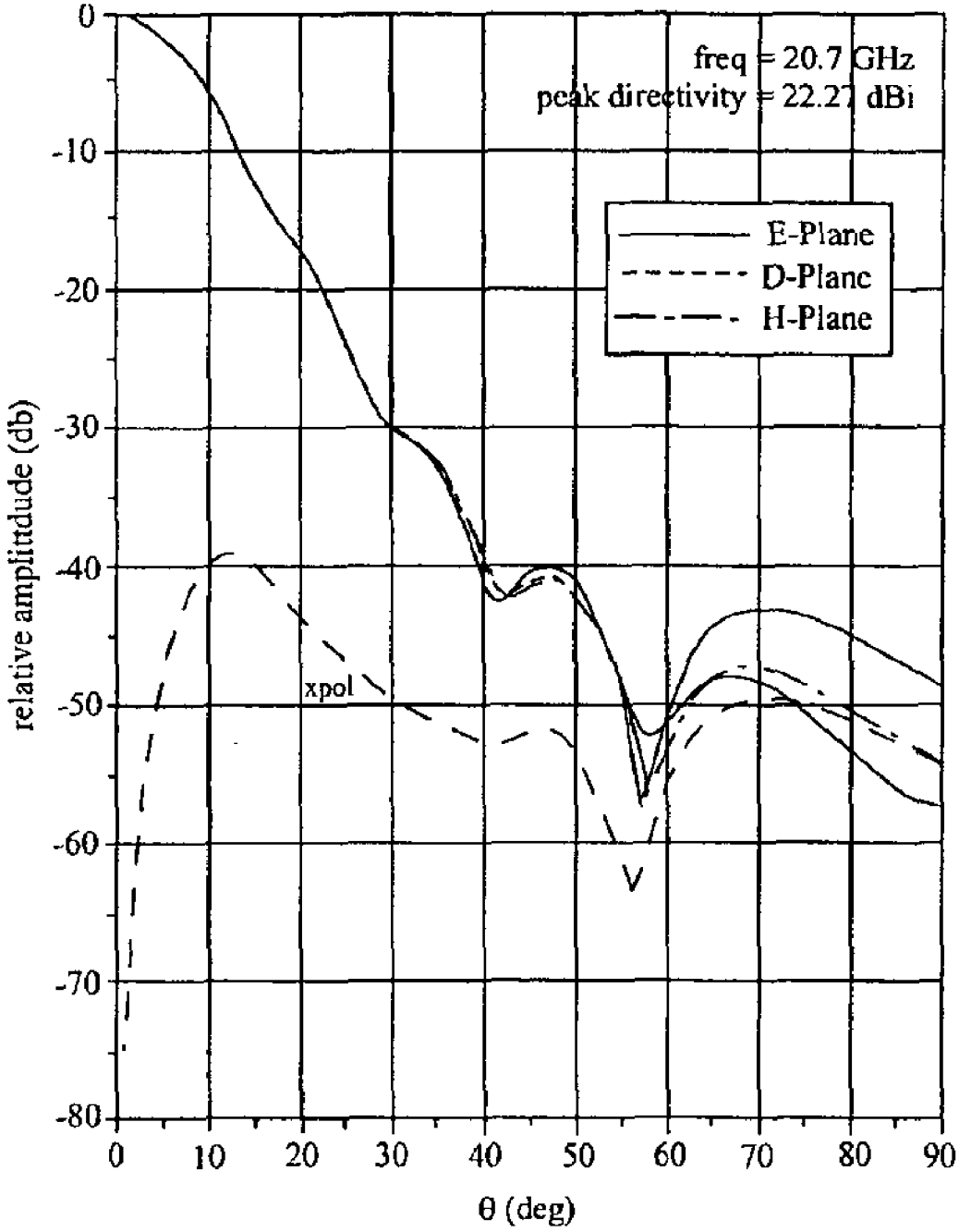
FIG. 14 is a diagram illustrating the co-polar and cross-polar radiation patterns of the corrugated horn of FIG. 13 at 20.7 GHz.
Figure 15:
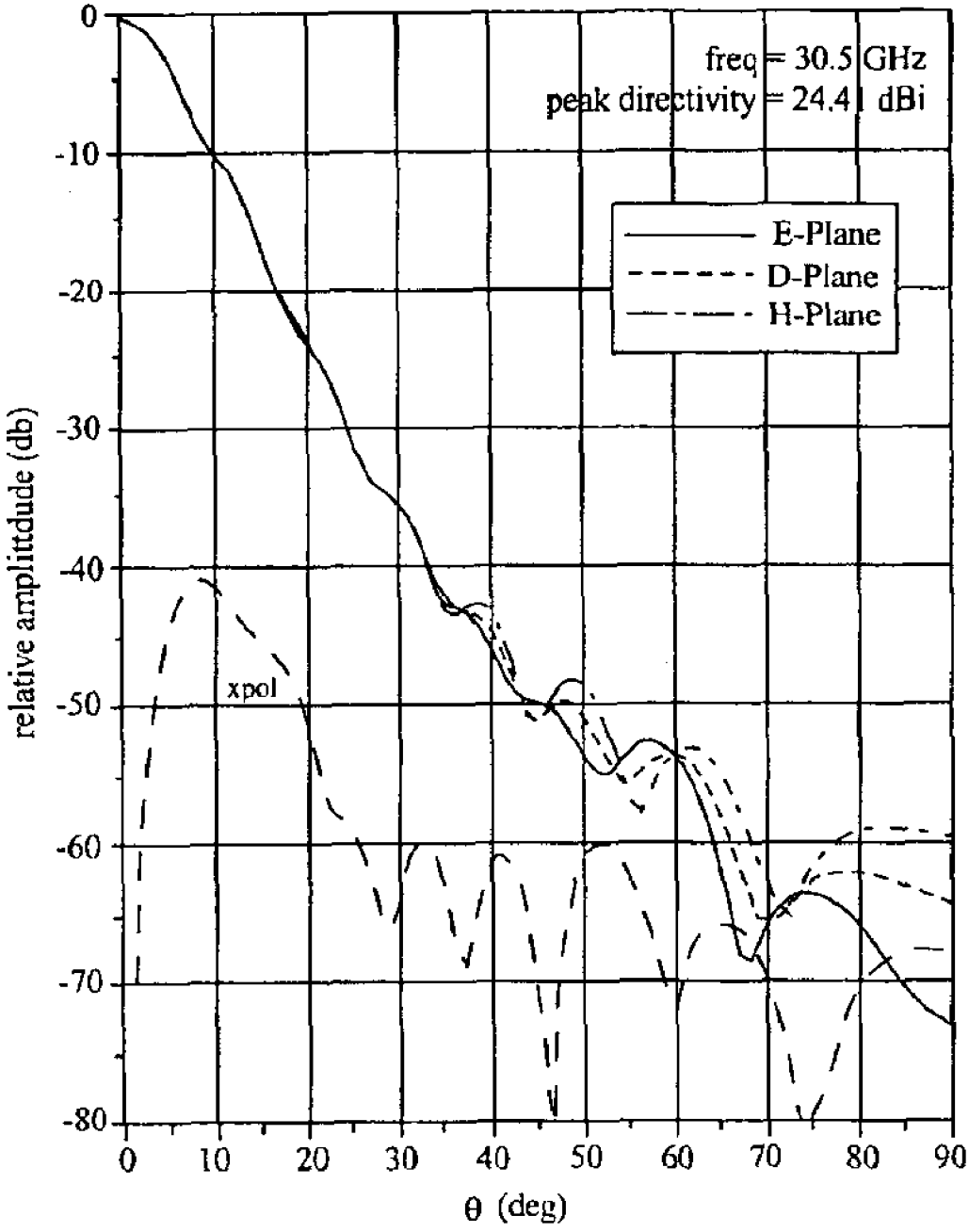
FIG. 15 is a diagram illustrating the co-polar and cross-polar radiation patterns of the corrugated horn of FIG. 13 at 30.5 GHz.
Figure 16:
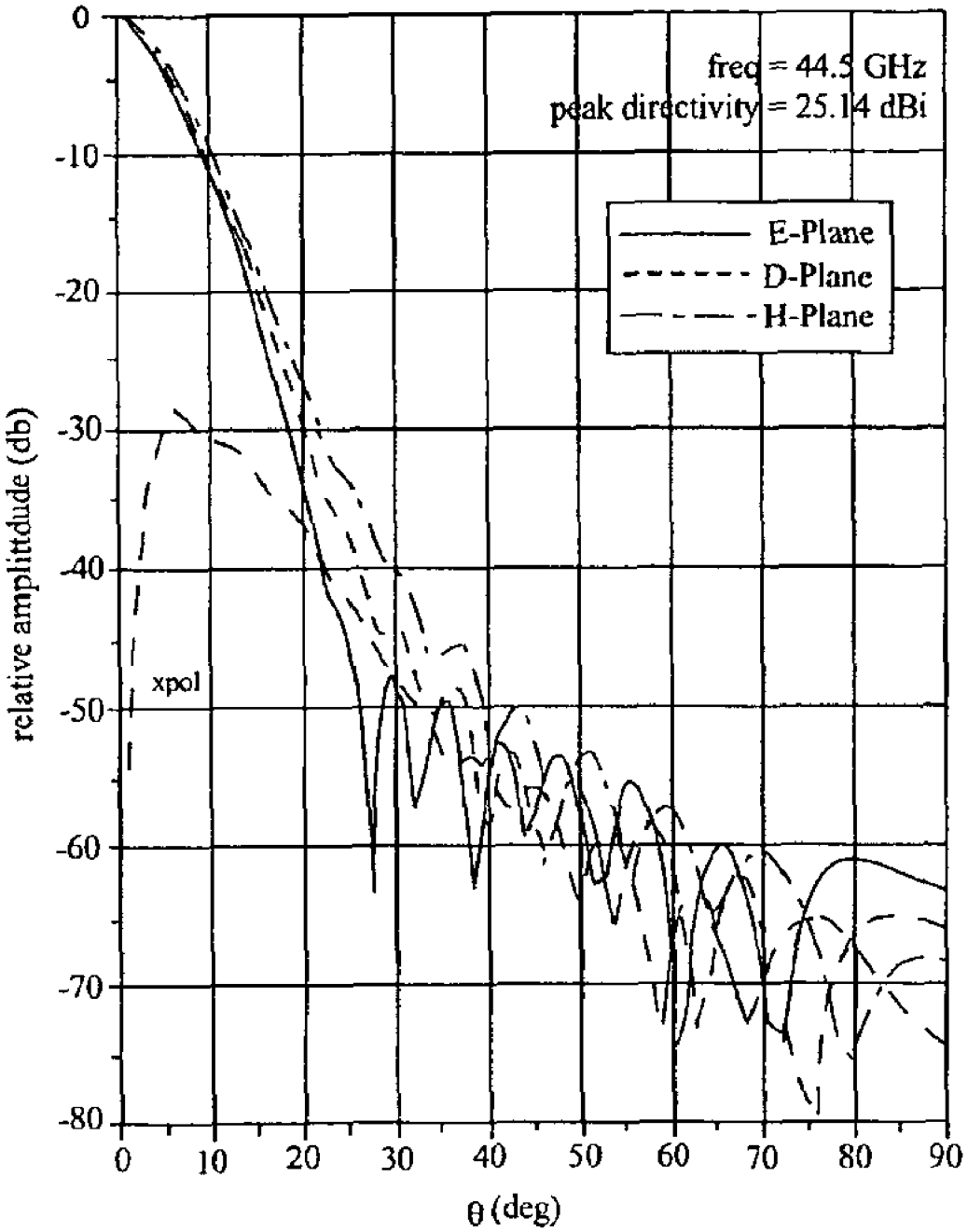
FIG. 16 is a diagram illustrating the co-polar and cross-polar radiation patterns of the corrugated horn of FIG. 13 at 44.5 GHz.
Figure 17:
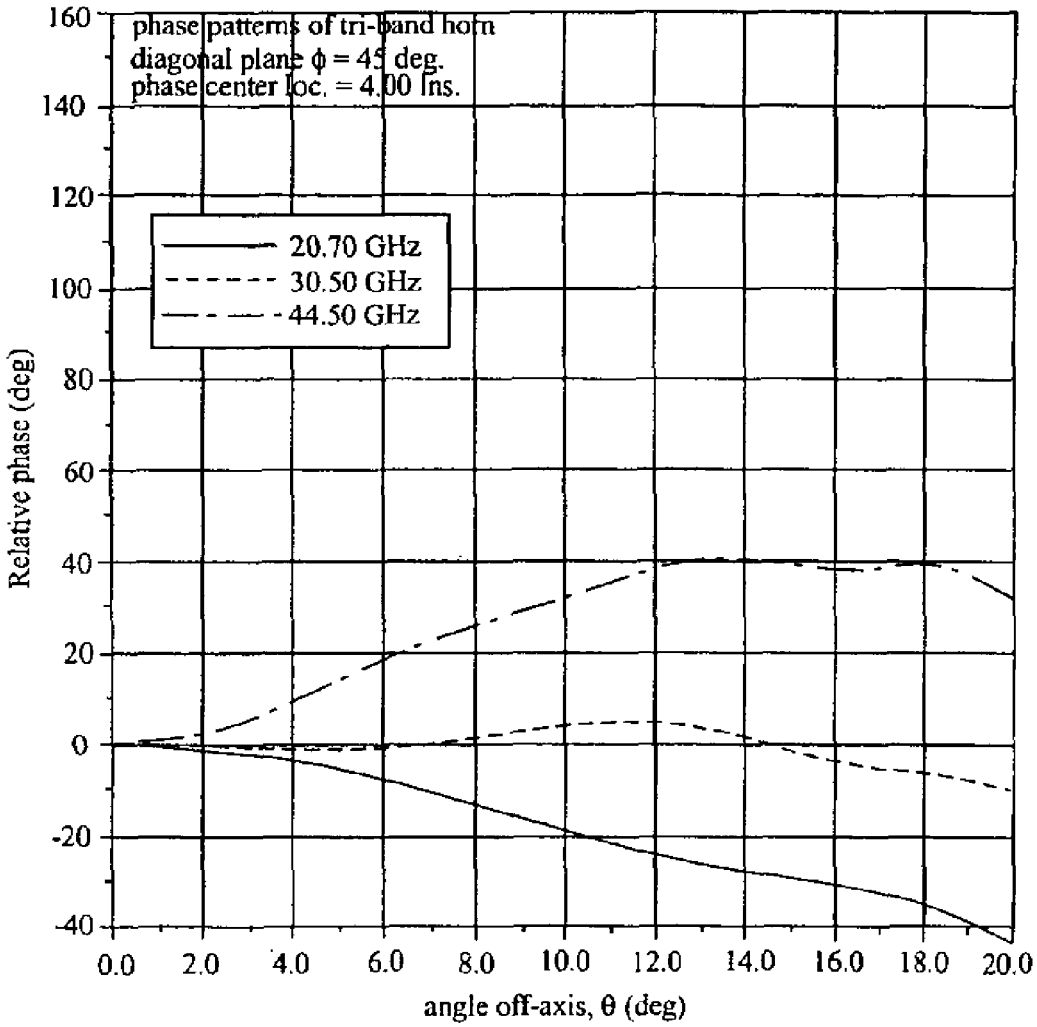
FIG. 17 is a diagram illustrating the co-polar phase patterns of the corrugated horn with an axis of rotation 4.0 inches behind the aperture plane.

The computed co-polar and cross-polar patterns in the E-plane, 45 degree plane, and H-plane are shown in FIGS. 14 to 16 at mid-frequencies of K, Ka, and EHF bands, respectively. The main beam is Gaussian in shape with no sidelobes or merged in sidelobes within the 20 degrees reflector illumination cone. Outside this cone, the sidelobes are below −36 dB relative to the peak. The cross-polar levels are extremely low (less than −38 dB) at K- and Ka-bands and lower than −28 dB at EHF frequencies. The performance of the horn over all the three bands is summarized in Table 2. The return loss is better than 30 dB at K & Ka bands and better than 27 dB at EHF. The phase patterns of the horn at the three bands are shown in FIG. 17 with the aperture plane moved 4 inches towards the reflector with respect to the focal point of the reflector. The phase patterns are relatively uniform with a maximum phase error of 32 degrees over the +/−20 degrees reflector field-of-view.

TABLE 2

| PARAMETER | K-BAND | Ka-BAND | EHF-BAND |
|---|---|---|---|
| Return Loss, dB | 30 | 33.6 | 27.1 |
| Peak Cross-Pol Level, dB | −38.9 | −40.8 | −28.4 |
| Illumination Taper, dB | 17.6 | 23.6 | 28.6 |
| Horn Directivity, dBi | 22.27 | 24.41 | 25.14 |

Figure 18:
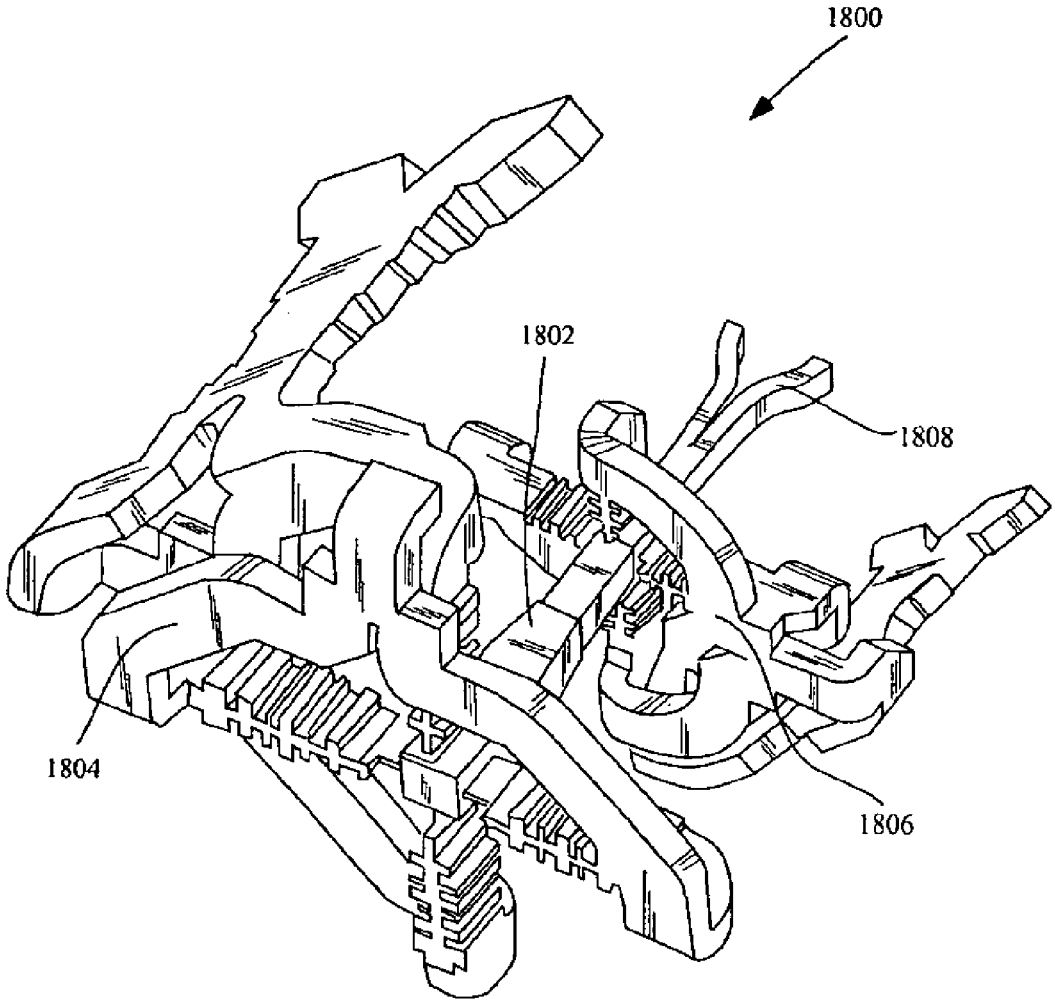
FIG. 18 is an isometric view of a tri-band OMT/Polarizer (TOP) assembly in accordance with the tri-band feed assembly shown in FIG. 12.

Referring to FIG. 18, shown is an isometric view of the tri-band OMT/Polarizer (TOP) 1800. The TOP 1800 comprises a 0.335 inch×0.335 inch square waveguide 1802 that interfaces with a 0.38 inches diameter circular waveguide through a matching transformer. The TOP 1800 includes a 4-port symmetrical OMT/Polarizer at K-band 1804, a 4-port symmetrical OMT/Polarizer at Ka-band 1806, and a septum polarizer 1808 for the EHF band. Table 3 summarizes the computed performance of the TOP at the three discrete frequency bands.

TABLE 3

| PARAMETER | K-BAND | Ka-BAND | EHF-BAND |
|---|---|---|---|
| Return Loss, dB | 33 | 33 | 26 |
| Axial Ratio, dB | 0.45 | 0.50 | 0.40 |
| Insertion Loss, dB | 0.30 | 0.35 | 0.40 |
| Reflections at Other Bands, dB | 50 & 60 @ Ka & EHF | 90 & 65 @ K & EHF | 100 & 70 @ K AND Ka |
| Polarization | LHCP & RHCP | LHCP & RHCP | LHCP & RHCP |
| Isolation, dB (RHCP to LHCP) | >25 dB | >25 dB | >30 dB |

In one embodiment, the tri-band antenna design can be extended to quad-band and other multi-band applications. The extended multi-band antennas can carry 4 or 5 frequency bands supporting multiple services using a single antenna. The advantage of this design is that the multi-band antenna can employ a common reflector and add X-band and/or C-band feed elements to the tri-band feed described above. In an alternative design of the present invention, a separate reflector may be used for all the different communication bands. For example, a separate reflector may be employed for the X-band and/or the C-band signals. Additionally, separate reflectors may be used for the K, Ka, and EHF band signals.

Figure 19:
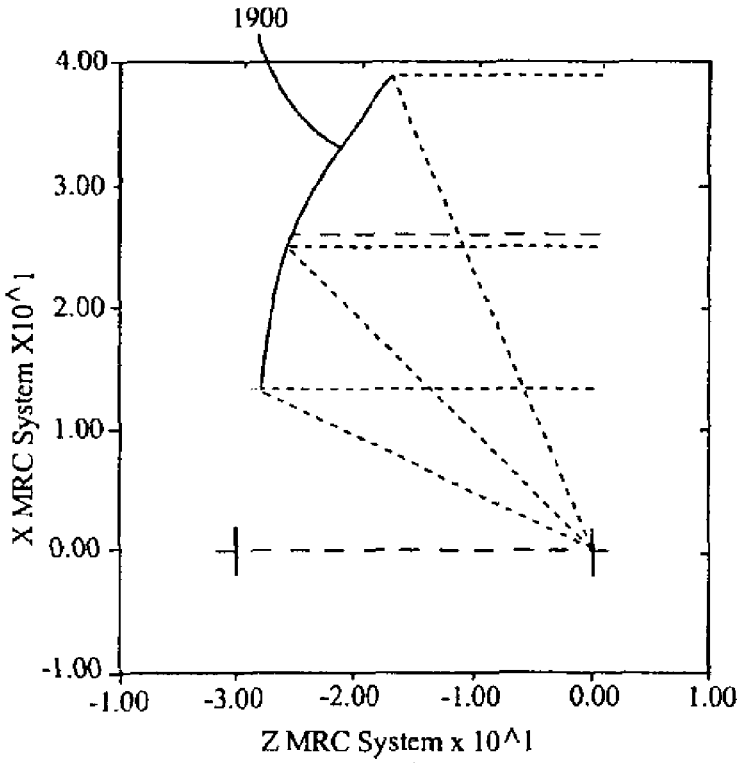
FIG. 19 is a diagram illustrating a reflector geometry and feed geometry for a quad-band antenna system.
Figure 19:
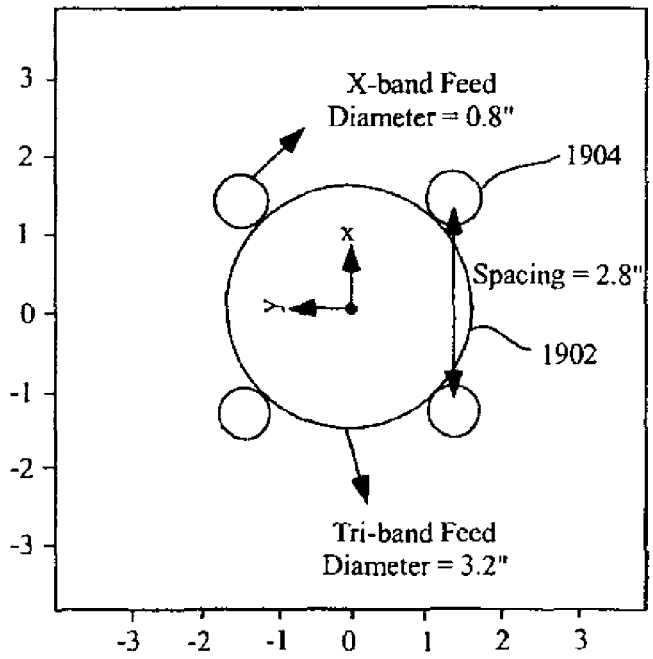

FIG. 19 shows the geometry of the quad-band antenna. Shown is a reflector 1900, a tri-band band feed 1902, and a plurality of X-band feed elements 1904. The feed assemble comprises a central 20/30/45 GHz tri-band feed 1902 surrounded by 4 X-band feed elements 1904. Helical radiating elements are used for the X-band since the waveguide elements do not combine well to form a single beam with high efficiency. An axial mode helix design with 0.5 inches diameter of helix and 2.8 inches spacing among elements in both elevation and azimuth planes is selected for the quad-band design. Each helix requires about 9 turns in order to broaden the element beams. The four helices are fed with an X-band beam-forming network to form a single circular beam.

Figure 20:
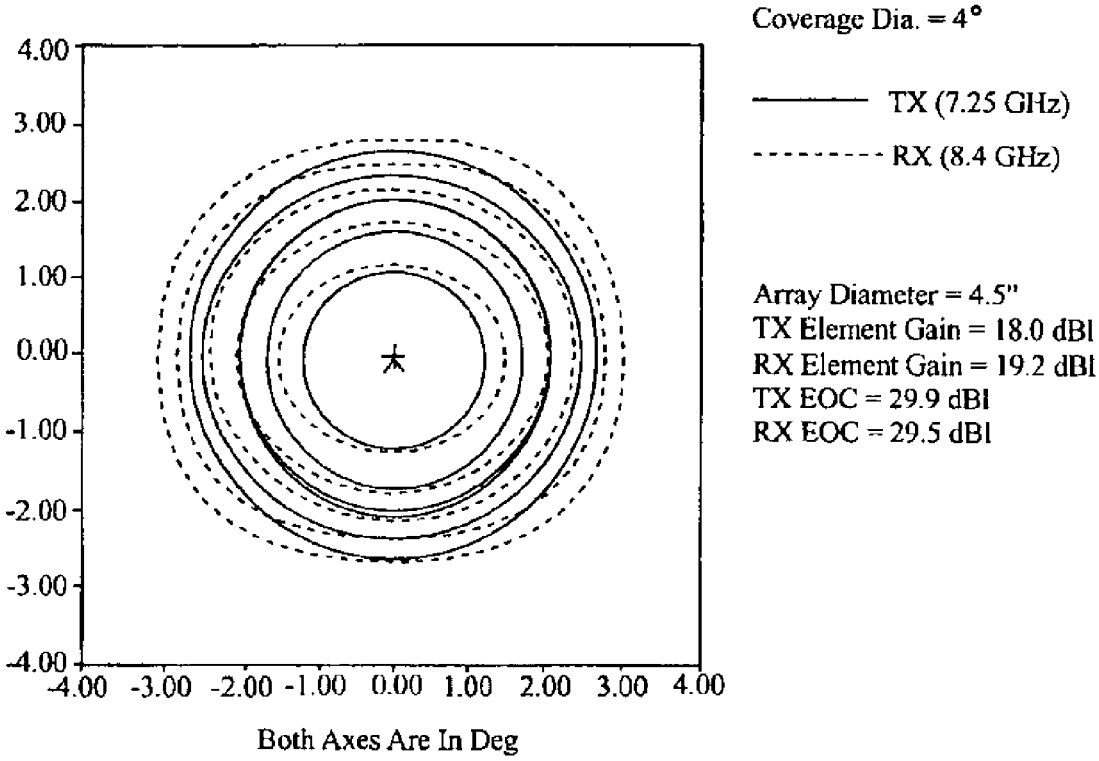
FIG. 20 is a diagram illustrating computer X-band directivity contours using feed assembly shown in FIG. 19.

The computed secondary beams with the reflector at X-band are shown in FIG. 20. For a 4.0 degree diameter coverage, the computed minimum directivity values are 29.9 dBi at 7.25 GHz and 29.5 dBi at 8.4 GHz. The quad-band design can further be extended to C-band by adding another 4 helices around the tri-band feed, shown in FIG. 18, and rotated 45 degrees relative to the X-band helices. Such a multi-band antenna can support multiple communications services including, e.g., at least WGS, TCA, EHF and FAB_T.

Similar to the X-band, four C-band helices may be added to either the tri-band antenna feed shown in FIG. 12 or to the quad-band antenna system shown in FIG. 19. The C-band helices are fed with a C-band beam forming network to form a single circular beam.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. An antenna comprising:

a reflector having a reflector surface profile for reflecting a signal comprising a plurality of communication bands;

a multi-depth corrugated horn assembly for receiving the signal comprising the plurality of communication bands;

a stepped waveguide coupled to the corrugated horn;

a first polarizer coupled to the stepped waveguide for separating a first communication band from the plurality of communication bands;

a second polarizer coupled to the stepped waveguide for separating a second communication band from the plurality of communication bands; and a third polarizer coupled to the stepped waveguide for separating a third communication band from the plurality of communication bands.

2. The antenna of claim 1 further comprising an input matching section coupled between the multi-depth corrugated horn and the stepped waveguide.

3. The antenna of claim 1 wherein the first polarizer comprises:

a plurality of 20 GHz slots coupled to the stepped waveguide;

a first plurality of band reject filters coupled to the plurality of 20 GHz slots;

a first plurality of magic T networks coupled to the first plurality of band reject filters;

a K-band short slot coupler coupled to the first plurality of magic T networks;

a 20 GHz LHCP port coupled to the K-band short slot coupler; and a 20 GHz RHCP port coupled to the K-band short slot coupler.

4. The antenna of claim 3 wherein the second polarizer comprises:

a plurality of 30 GHz slots coupled to the stepped waveguide;

a second plurality of band reject filters coupled to the plurality of 30 GHz slots;

a second plurality of magic T networks coupled to the second plurality of band reject filters;

a Ka-band short slot coupler coupled to the second plurality of magic T networks;

a 30 GHz LHCP port coupled to the Ka-band short slot coupler; and a 30 GHz RHCP port coupled to the Ka-band short slot coupler.

5. The antenna of claim 4 wherein the third polarizer comprises a septum polarizer having a 45 GHz LHCP port and a 45 GHZ RHCP port.

6. A method of transmitting data comprising:

reflecting a signal comprising a plurality of communication bands into a corrugated horn having dual depth corrugations; and separating each of the plurality of communication bands with a multi-band polarizer;

wherein plurality of communication bands comprises a K-band signal, a Ka-band signal and a EHF-band signal.

7. The method of claim 6 further comprising directing the signal from the corrugated horn into a waveguide.

8. The method of claim 7 further comprising:

stopping propagation of the K-band signal in the waveguide with a first step junction; and stopping propagation of the Ka-band signal in the waveguide with a second step junction.

9. A feed for an antenna system comprising:

a wideband corrugated horn comprising a plurality of dual depth corrugations;

a waveguide coupled to the wideband corrugated horn, the waveguide comprising a first step junction and a second step junction;

a first polarizer coupled to the waveguide in between the wideband corrugated horn and the first step junction;

a second polarizer coupled to the waveguide in between the first step junction and the second step junction; and a third polarizer coupled to the waveguide after the second step junction.

10. The feed for an antenna system of claim 9 wherein the first step junction stops the propagation of a K-band signal and wherein the second step junction stops the propagation of a 30 GHz signal Ka-band signal.

11. The feed for an antenna system of claim 10 wherein the third polarizer receives an EHF-band signal.

12. The feed for an antenna system of claim 9 further comprising an input matching section coupled between the wideband corrugated horn and the waveguide.

13. The feed for an antenna system of claim 9 wherein the first polarizer comprises:

a plurality of 20 GHz slots coupled to the stepped waveguide;

a first plurality of band reject filters coupled to the plurality of 20 GHz slots;

a first plurality of magic T networks coupled to the first plurality of band reject filters;

a K-band short slot coupler coupled to the first plurality of magic T networks;

a 20 GHz LHCP port coupled to the K-band short slot coupler; and a 20 GHz RHCP port coupled to the K-band short slot coupler.

14. The feed for an antenna system of claim 9 wherein the second polarizer comprises:

a plurality of 30 GHz slots coupled to the stepped waveguide;

a second plurality of band reject filters coupled to the plurality of 30 GHz slots;

a second plurality of magic T networks coupled to the second plurality of band reject filters;

a Ka-band short slot coupler coupled to the second plurality of magic T networks;

a 30 GHz LHCP port coupled to the Ka-band short slot coupler; and a 30 GHz RHCP port coupled to the Ka-band short slot coupler.

15. The feed for an antenna system of claim 9 wherein the third polarizer comprises a septum polarizer having a 45 GHz LHCP port and a 45 GHZ RHCP port.

16. A apparatus for use in a communication system comprising:

means for reflecting a set of beams from an antenna into an antenna feed, the beam comprising a K-band signal, a Ka-band signal, and an EHF-band signal;

means for separating the K-band signal from the set of beams;

means for separating the Ka-band signal from the set of beams; and means for separating the EHF-band signal from the set of beams.

17. The apparatus of claim 16 further comprising:

means for separating the K-band signal into a K-band LHCP signal and a K-band RHCP signal;

means for separating the Ka-band signal into a Ka-band LHCP signal and a Ka-band RHCP signal; and means for separating the EHF-band signal into a EHF-band LHCP signal and a EHF-band RHCP signal.

18. The apparatus of claim 17 further comprising:

means for reflecting a X-band signal, wherein the set of beams further comprises the X-band signal; and means for separating the X-band signal from the set of beams.

19. The apparatus of claim 18 further comprising means for forming an X-band single circular beam.

20. The apparatus of claim 17 further comprising:

means for reflecting a C-band signal, wherein the set of beams further comprises the C-band signal; and means for separating the C-band signal from the set of beams.

21. The apparatus of claim 20 further comprising means for forming a C-band single circular beam.

22. The apparatus of claim 20 further comprising:

means for reflecting a X-band signal, wherein the set of beams further comprises the X-band signal; and means for separating the X-band signal from the set of beams.

23. The apparatus of claim 22 further comprising means for forming an X-band single circular beam.

* * * * *

UNITED STATES PATENT AND TRADEMARK OFFICE

CERTIFICATE OF CORRECTION

PATENT NO. : 6,937,203 B2
DATED : August 30, 2005
INVENTOR(S) : Rao et al.

It is certified that error appears in the above-identified patent and that said Letters Patent is hereby corrected as shown below:

Column 12,
Line 25, change “GHZ” to -- GHz --.
Line 60, after “GHz” delete “signal”.

Column 13,
Line 31, change “GHZ” to -- GHz --.

Signed and Sealed this

Thirty-first Day of January, 2006

JON W. DUDAS
*Director of the United States Patent and Trademark Office*